United States Patent [19]

Dohmann et al.

[11] Patent Number: 4,621,514

[45] Date of Patent: Nov. 11, 1986

[54] METHOD OF MAKING AN INTERMEDIATE STAGE, INTERMEDIATE BLANK FOR A DYNAMO ELECTRIC MACHINE COMMUTATOR RING, AND APPARATUS TO CARRY OUT THE METHOD

[75] Inventors: Fritz Dohmann, Paderborn; Peter Franz, Diekholzen; Friedrich Klaas, Altenbeken; Günter Schulze, Klein Elbe, all of Fed. Rep. of Germany

[73] Assignee: Robert Bosch GmbH, Stuttgart, Fed. Rep. of Germany

[21] Appl. No.: 650,348

[22] Filed: Sep. 13, 1984

[30] Foreign Application Priority Data

Sep. 15, 1984 [DE] Fed. Rep. of Germany ..... 3333335

[51] Int. Cl.[4] ..... B21D 22/00

[52] U.S. Cl. ..... 72/354; 72/370; 29/597

[58] Field of Search ..... 72/354, 359, 370; 29/597

[56] References Cited

U.S. PATENT DOCUMENTS

| | | | |
|---|---|---|---|
| 3,958,326 | 5/1976 | Matsumoto et al. | 29/597 |
| 4,370,799 | 2/1983 | Potocnik | 29/597 |
| 4,450,704 | 5/1984 | Schaeffler et al. | 72/354 |

FOREIGN PATENT DOCUMENTS

| | | | |
|---|---|---|---|
| 141348 | 11/1980 | Japan | 72/354 |
| 874255 | 10/1981 | U.S.S.R. | 72/354 |

*Primary Examiner*—Leon Gilden

*Attorney, Agent, or Firm*—Frishauf, Holtz, Goodman & Woodward

[57] ABSTRACT

To form a commutator segmental ring, an intermediate stage commutator ring (4) is formed from a flat strip (1) of commutator material which is bent into essentially cylindrical tubular shape to form a blank (2) having a gap or crack (3) adjacent the ends of the strip. The commutator ring, upon forming of the commutator, is severed into commutator segments. The gap or crack of the blank is aligned with a ridge or rib in a forming punch press to form a groove within the essentially cylindrical tubular blank (2) so that, when the intermediate stage commutator ring (4) is made, a cylindrical portion (5) already dimensioned for the intermediate segmental ring and a flange portion (6) are made, with a groove in alignment with the gap or crack obtained during cold-flowing of the metal in the press by the guidance afforded by the rib or ridge in the gap or crack of the cylindrical tubular blank. Preferably, the ridge or rib, defining the groove, extends in a plane which passes through the axis of the cylindrical portion (5) of the intermediate commutator ring (4) and extends radially therefrom through the center line of the groove. The apparatus includes multiple concentric punch, stamp and die elements to permit cold-flowing of the cylindrical tubular blank upon compression of the commutator metal which, typically, is copper.

20 Claims, 11 Drawing Figures

METHOD OF MAKING AN INTERMEDIATE STAGE, INTERMEDIATE BLANK FOR A DYNAMO ELECTRIC MACHINE COMMUTATOR RING, AND APPARATUS TO CARRY OUT THE METHOD

The present invention relates to the manufacture of a commutator for use in a dynamo electric machine, for example a starter motor, to start an internal combustion engine (ICE), and more particularly to a method to make an intermediate stage blank from which commutator segments can then readily be made, and to an apparatus to carry out the method.

BACKGROUND

Segmental commutator rings are frequently made by starting with a blank of rectangular plan view, that is, a strip of commutator material, typically copper, which is then formed into a cylindrical tube. It is known to shape such an element into a ring-shaped blank with parallel oppositely located ends which define a gap therebetween. This blank is then placed in a cold-flow press which has a press or stamp part with projecting teeth to define grooves in the subsequent commutator ring. The press, also, forms a flange at the end of the essentially cylindrical blank to provide connecting paths or tabs for the windings of a rotating armature, to be connected to the commutator segments. The grooves, which separate the commutator segments, remain connected by thin convex connecting ribs, later separated to separate the commutator segments, electrically, from each other, for example after the ring has been assembled on an insulating hub.

THE INVENTION

It is an object to reduce rejects and imperfectly formed commutator segmental rings, caused, for example, by misalignment of the gap of the preformed cylindrical blank with a rib or tooth of the punch element which deforms the cylindrical blank to form the flange thereon, for example by cold-flowing of the metal.

Briefly, it has been found that difficulties in cold-forming segmental rings of the type described arise due to the gap of the cylindrical blank escaping from the region of a rib or tooth of the segment forming punch, for example due to the comparatively long path of the deforming punch in carrying out the cold-flowing operation, and the high forces required for cold-flowing the metal to form the laterally projecting flange on the commutator ring.

The method, in accordance with the invention, provides for making an intermediate stage or intermediate blank which is formed with a groove where two commutator segments are to adjoin each other, the groove being made by guiding the forming or flowing step of the metal to form the groove, such that its center line coincides with the gap of the tubular blank. This guidance step can be carried out, in accordance with a feature of the invention, by a deformation punch or die which has a rib projecting from a cylindrical surface, the rib being in alignment with and matching the gap where the edges of a rolled, initially essentially rectangular blank meet after forming the flat rectangular blank into cylindrical shape.

Preferably, the groove which is located in the position of the gap extends in a plane which passes through the axis of the cylinder defined by the rolled, initially flat blank, and extends radially therefrom through the center line of the then formed groove.

The method has the advantage that the blank need not be formed with chamfered or relieved end portions to define a positioning groove, but, rather, the hollow cylindrical blank is deformed to have a shaft portion and a flange portion at an end thereof, the flange being dimensioned already to have the height of the commutator segment connecting tabs when the commutator is eventually made, and the cylindrical portion having the length of the commutator segments. The press or punch for deforming the metal is simple, and requires only an element which forms a groove, and to so direct and guide the flow of metal during cold-flowing thereof that the gap of the initial blank will match the groove, and be located in the desired plane, for example extending radially through the longitudinal axis of the intermediate blank which will be made in accordance with this method. This insures that upon subsequent deformation of the intermediate stage into a commutator segmental ring, the gap can no longer be deflected from its predetermined position and direction, for example,and preferably axially with respect to the cylindrical portion. The commutator segments which are subsequently made, as well known in accordance with prior art methods, initially remain connected by narrow connecting bridges or ribs. The groove, which is formed left over after the gap of the cylindrical blank has been shaped into the intermediate blank, is necessary anyway since, if there would be a connection or if a connection results due to cold-flowing, the connecting rib or bridge will be severed later; absence of a bridge is immaterial since it would be severed, at a later time, anyway.

The method has the further advantage that all commutator segments will have the same size, and the commutator segments adjacent the gap likewise will have the same size. The operating lifetime, before resharpening or replacement of the elements which make the commutator segments, is substantially enhanced, and the forces necessary in the two-step process, cumulatively, are less than in a one-step deformation in accordance with the prior art.

In accordance with a preferred feature of the invention, the deformation or flowing of the metal is guided by a rib placed on either an internal or an external part of the deformation punch, that is, on the punch element or a die element, or on both, the rib being shaped to form the then desired groove. At the same time that the flange is formed by cold-flowing of the metal, additional seating and retaining elements or profiles for the commutator segments to be made, or for attachment to an insulating hub, can be formed at the same time.

DRAWINGS

DETAILED DESCRIPTION

Figure 1:
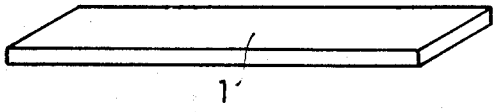
FIG. 1 is a perspective view of a blank, showing the starting element.
Figure 2:
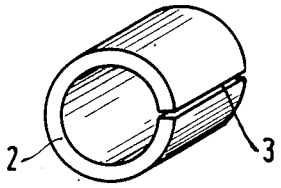
FIG. 2 is a pictorial view showing the blank of FIG. 1 deformed in a first deformation step into cylindrical shape.

The initial blank starting material is a rectangular strip 1 (FIG. 1), for example of copper, which, in a first step, is bent into hollow cylindrical shape (FIG. 2) to form an essentially cylindrical, tubular blank 2 with a butt-gap 3 formed by the narrow end portions of the rectangular blank 1. The gap 3 may be very narrow and, essentially, be formed only by the return springiness of the metal after having been bent into the cylindrical blank 2. The cross section of the blank 1 can be rectangular, as shown, or round, then forming a ring with the butt-gap.

The blank 2 is then shaped into the intermediate-stage commutator ring 4 of the present invention. In general, the intermediate ring 4 has a hollow cylindrical shaft portion 5 and an end flange 6, projecting radially at right angles with respect to the axis of the hollow cylindrical portion 5. This is the most common form of commutator ring; the intermediate stage may, however, also be formed without the flange, or in disk shape for a flat commutator segmental ring. Other structures can be made, similarly, by suitably changing the cold-flowing or cold-pressing tool, that is, both its punch as well as its die elements.

Figure 11:
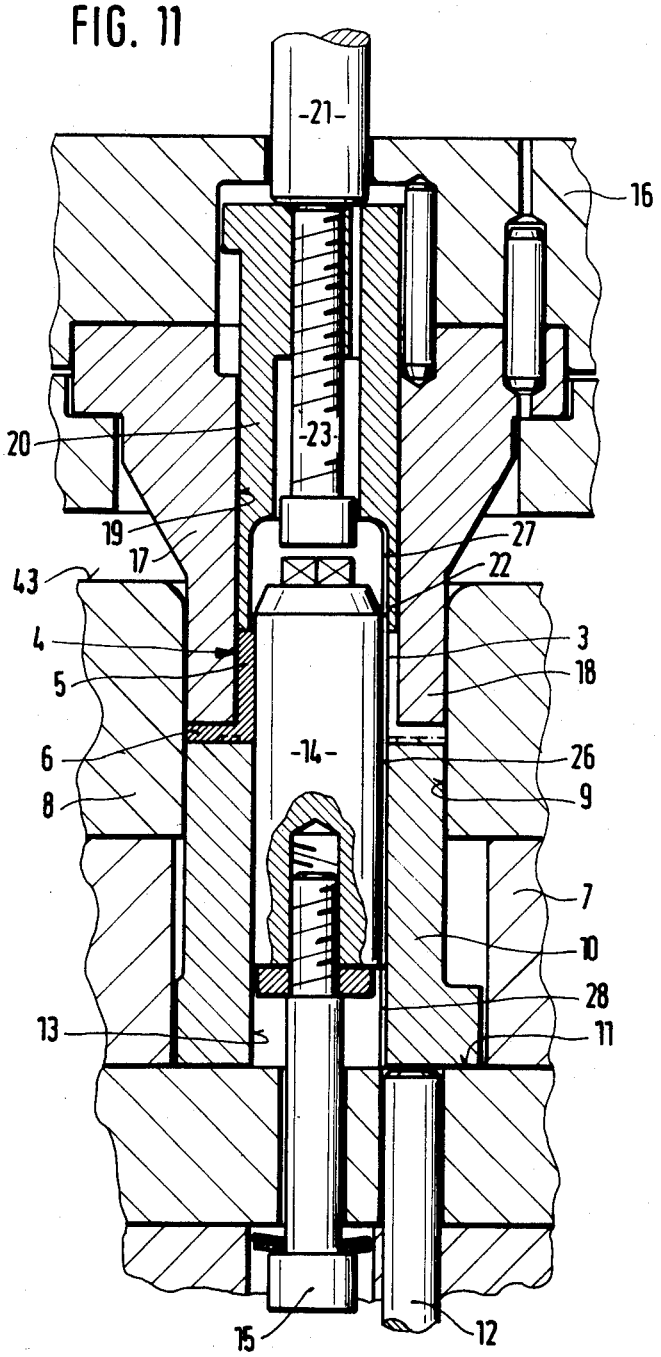
FIG. 11 is a vertical longitudinal sectional view through a deforming and cold-flowing press.

The apparatus or tool for backward-hollow flow pressing or cold-flowing is shown, in longitudinal section, in FIG. 11.

The apparatus has a lower stamp plate 7 supporting an outer die 8, having a cylindrical bore 9 of a diameter corresponding to the outer diameter of the flange portion 5 of the intermediate element 4. A hollow ejector 10 is operable in the bore 9, movable further in a cylindrical opening of the lower plate 7. The ejector 10, upon insertion of the blank, is seated on the bottom 11 of the bore 9. It can be moved upwardly by a push rod 12.

The ejector 10 also forms the counter or bottom element during cold-flowing of the blank 2 to form the intermediate blank 4.

The ejector 10 has a longitudinal bore 13 in which an inner punch die 14 is movable. The cylindrical inner die 14, upon insertion of the blank 2, is seated on the bottom 11 of the bore 9. A stop element 15, limiting the upward stroke of the inner die 14, is adjustably connected thereto, for example by screw threads. Preferably, and as shown, a spring washer element is interposed between the head of the stop element 15 and the bottom plate of the apparatus, defining the surface 11, to provide for resilient engagement.

A head element 16 retains a deformation stamp 17. It is movable with the head element 16. The deformation stamp 17 has a sleeve-like portion 18 which is movable in the die 8. The end portion 18 forms the actual deformation punch or press element. The punch 17 has a longitudinal bore in which a counter punch 20 is longitudinally movably guided. The counter punch 20 is movable with respect to the upper element 16 by an upper punch 21, which can push the element 20 downwardly with respect to the element 17 and, to the upper plate 16, towards the lower element 7. The counter stamp 20 is used as a counter element located at the end of the cylindrical portion 5 of the intermediate blank which is to be formed. The counter stamp 20 has a hollow cylindrical end portion 22 which permits shaping of the cross section of the intermediate blank 4 at the end of the cylindrical portion 5. Its internal diameter can be slightly greater than the outer diameter of the inner punch 14 in order to permit escape of a small quantity of material in the ring gap between the punch elements. The counter punch 20 may, additionally, form an auxiliary or further ejector, if the intermediate element 4 should, possibly, be retained on, or stick to, the deformation punch elements 17, 18 upon movement of the ejector 10. A punch rod 23, in form of a threaded bolt, is located in the counter element 20, so that the end position of the counter element 20 in the element 17 and, hence, with respect to the upper element 16, can be adjusted. The head of the bolt 23 functions, further, as an upper stop to limit the movement of the inner stamp element 14.

Operation: Upon shaping of the blank 2 into the intermediate blank stage 4, the gap 3 must be retained as a straight gap which, in the embodiment shown, extends parallel to the longitudinal axis of the cylindrical portion 5 of the intermediate element 4, that is, extends parallel to a plane which projects radially through the longitudinal axis. A commutator ring can then be formed in a subsequent stage, not shown specifically and well known per se, in which the gap then will be in the groove between segmental elements and will not have deflected or deviated into an adjacent segment. The apparatus of FIG. 11, thus, is formed, in a simple and reliable manner, with means to guide the flow of workpiece material of the blank 2 when forming the intermediate blank 4. These flow-directed means provide a groove at least on the cylindrical portion of the intermediate blank 4, which is coincident with the gap defined or formed by the abutting ends of the original blank 2.

The guide elements, which define the groove, are formed as ribs or ridges on either the inner stamp element 14, the outer stamp element 17, the counter element or ejector 10, or on one or more of these elements, as will appear, in detail, in connection with the description of FIGS. 3 to 10, to which reference will now be made.

Figure 3:
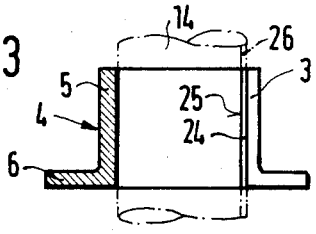
FIGS. 3 to 10 are schematic longitudinal, part-sectional views showing various embodiments of the guiding and deforming or cold-flowing steps, respectively.

Embodiment of FIG. 3: The intermediate stage or blank 4 has a longitudinal groove 24 in the inner wall of cylindrical portion 25, coincident with the gap 3. The inner punch element 14 of the apparatus of FIG. 11 is formed with a longitudinal rib or ridge 26 (FIG. 3). The ejector 10 and the counter element 20 are formed with a corresponding longitudinal grove 27, 28 (FIG. 11) respectively.

Figure 4:
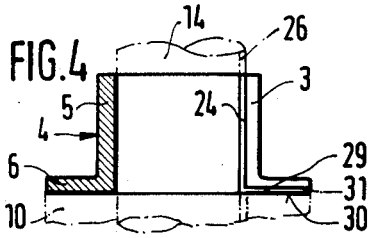

Embodiment of FIG. 4: The longitudinal groove 24 is extended in the shape of a radial groove 29 at the lower facing side 30 of the flange 6. The ejector 10 is formed at its upper end face with a radial rib 31 which extends in the same radial plane as the longitudinal rib 26 of the inner punch 14 through the longitudinal axis of the intermediate element 4. The gap 3 in the flange 6, thus, will be coincident with the radial grooves 24 and 29.

Figure 5:
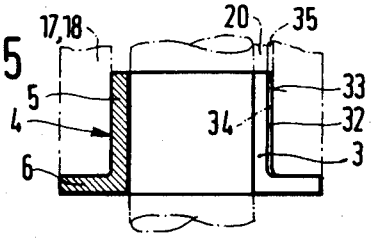

Embodiment of FIG. 5: The intermediate element 4 has a longitudinal groove at the outer surface 33 of the cylindrical portion 5. The end portion of the stamp element 17 (FIG. 11) is formed with a longitudinal rib 34, and the counter element 20 is formed with a longitudinal groove 35 to permit operation of the ridge ot rib 34 with respect to the counter element 20, and to provide an interengaging space.

Figure 6:
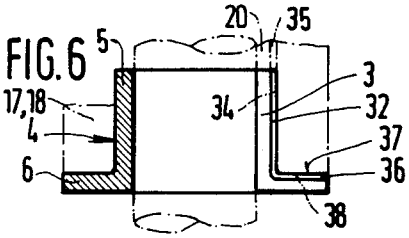

Embodiment of FIG. 6: The longitudinal groove 32 (FIG. 5 is extended into a radial groove 36 at the back side 37 of the flange 6, essentially congruent with the gap 3. The end portion 18 of the deformation stamp 17 is formed with a radial rib 38, forming an extension of the longitudinal rib 34 at the end face of the stamp 17.

Figure 7:
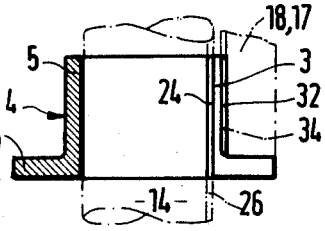

Embodiment of FIG. 7: A longitudinal groove 24 at the inside of the intermediate blank, as well as the longitudinal groove 32 at the outside thereof, is formed on the cylindrical portion 5 of the intermediate blank 4. The apparatus includes a longitudinal rib 26 on the inner punch 14, and a longitudinal rib 34 on the outer punch 17,18.

Figure 8:
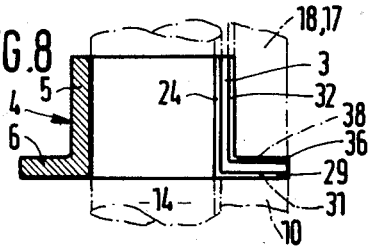

Embodiment of FIG. 8: The grooves 24, 29 (FIGS. 3, 4) and 32, 36 (FIGS. 5, 6) are combined and all formed on the intermediate blank 4.

Various other combinations of formation of grooves, both on the longitudinal or cylindrical portion 5 as well as on the flange portion 6 of the intermediate blank 4 are possible.

Figure 9:
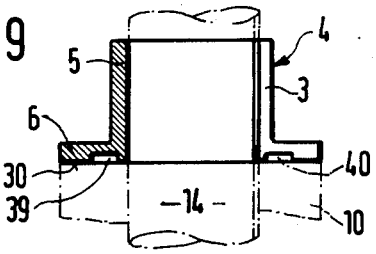

Embodiment of FIG. 9: It is frequently desirable to provide additional anchoring or bonding surfaces on the commutator ring to securely attach the commutator segments to a hub. In the embodiment of FIG. 9, a ring-shaped recess or groove is formed on the end face 30 of the flange 6. To form the groove 39, the ejector 10 has a ring-shaped projection 40 on its end face, the metal flowing around the ring-shaped projection 40 to then form, upon ejection, the groove 39.

Figure 10:
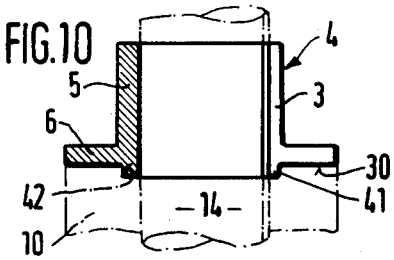

Embodiment of FIG. 10: The end face 30 of the flange 6 is formed with a ring-shaped extension 41. The ejector 10 of the apparatus of FIG. 11 is formed with an enlarged end portion 42 of its longitudinal bore 13 to permit the metal to flow thereinto, and thus to form the ring-shaped end portion 41.

Groove 39 (FIG. 9) and/or the extension 41 (FIG. 10) form additional anchoring or attachment elements for the segments, already applied to the intermediate blank 4. The commutator segments themselves will be made, in accordance with well known procedure, in a subsequent process, in which the commutator segments themselves will be formed and applied to an insulating hub. The insulating hub, in which the segments of the commutator are to be secured later on, is formed with a ring engaging the end face 30 of the segments, after severing of the ring into segmental portions, the ring being shaped to grip respectively, into the groove 39 (FIG. 9) or around the projecting portions 41 (FIG. 10).

In the production method, the blank 2 is introduced into the apparatus of FIG. 11, which, at that position, is opened. When the apparatus is open, the upper element 16 with the deformation stem 17 and the counter stem 20 are lifted off the lower stamp plate 7, element 8, and ejector 10, as well as the inner stamp 14. The end portion 18 of the deformation stamp 17 is thus placed at suitable height above the upper end of the die 8, that is, spaced from the upper receiving surface 43 of the die 8. The facing sides of the stamps 17, 18 and counter stamp 20 are in one plane. The inner stamp 14 and the ejector 10 are on the bottom 11 of the bore 9 in the die 8, and the lower stamp plate 7. The blank 2 is pushed over the inner stamp 14 on the ejector 10 in such a manner that the gap or crack 3 of the blank 2 is in alignment with the rib 26 of the inner stamp 14. Intermediate stages 4 in which the longitudinal groove is located at the outer circumference of the cylindrical portion, for example FIGS. 5 and 6, can be located by well known alignment means or indices, not shown, and of any suitable and standard construction, for example punch marks and the like.

After insertion of the blank 2, the upper stamp plate 16 is lowered until the end portion 18 of the stamp 17 with the counter stamp 20 engages the blank 2. Power is then applied, and the deformation stamp 17, 18 is pressed on the blank 2, so that the intermediate blank 4 will be formed by backward hollow flow compression or pressing. The deformation stamp 17, 18 thus forms the flange 6 with the dimension, that is, the thickness, of the connecting tabs which the commutator segments of the commutator segment rings should have when the commutator segment ring is then made, in well known manner. The major deformation and sizing step, thus, is done in the process in accordance with the present invention. The material of the blank 2 which escapes in the space defined by the inner stamp 14, the end portion 18, and the counter stamp 20, and which is of hollow cylindrical shape, is formed into the cylindrical portion 5 of the intermediate blank 4. The length of the shaft 5 is determined by the counter stamp 20, forced downwardly by force acting on the element 21. The inner stamp 14, freely movable within the ejector 10, is carried along upon formation of the cylindrical portion 5 by the frictional forces arising between the inner stamp 14 and the cylindrical portion 5 of the blank 4, and thus is held within the deformation stamps or dies 17, 18, and forms the longitudinal groove 24 by its longitudinal rib 26. The longitudinal rib 26 so guides the flow of the material of the blank 2 that the gap or crack 3 is deformed into a straight groove or gap which extends in predetermined direction, for example in a plane which is parallel to the longitudinal axial of the intermediate blank 4 and extending radially through the longitudinal axis thereof—compare FIG. 11 and intermediate stage 4 as illustrated in FIG. 3.

After cold-flowing of the material, for example copper, of the blank 2 and deformation into blank 4, the upper plate 16 and the stamps 17, 18 are retracted, that is, moved upwardly into the initial position. The ejector 10 pushes the intermediate element 4 off the inner stamp portion 14 which returns into its initial position at the bottom 11 of the bore 9, thus ejecting the blank 4 from the die 8. It is possible that the blank 4 might adhere to the deformation stamps 17, 18. In that case, the counter stamp 20 will function as an additional ejector before it is returned to its initial position. After both the ejector 10 as well as the counter stamp 20 have reliably ejected the intermediate blank 4, the ejector 10 and the counter stamp 20 return to the initial position.

Sequential operation of the various stamp elements can be controlled in any well known and suitable manner, for example electrically, or by cams acting on the respective elements. Apparatus to move the respective ejectors and stamp element has been omitted from the drawing for clarity, since it is well known and can be constructed in any suitable manner. Likewise, retention springs and the like have been omitted, and can be placed as indicated by well known engineering practice.

Various changes and modifications may be made, and any features described herein may be used with any of the others, within the scope of the inventive concept.

We claim:

1. A multi-step process for the production of a commutator segmental ring, comprising the steps of:

making an unsegmented intermediate stage commutator ring (4) from a flat strip (1) of commutator metal by bending the flat strip (1) to form an essentially cylindrical tubular blank (2) having a gap or crack (3) adjacent the ends of the strip (1);

placing the thus-formed cylindrical tubular blank (2) in a forming press;

forming or flowing the metal of the essentially cylindrical tubular blank (2) in said forming press into a cylindrical portion (5) dimensioned for the intermediate stage commutator ring (4) and a flange portion (6) projecting laterally from the cylindrical portion, said flowing or forming step including guiding the flowing or forming of the metal in an essentially axial direction to form a rectilinear groove, the center line of which groove coincides with said gap or crack (3) of the tubular blank, and subsequently deforming said intermediate state ring (4) into a ring having segments defined by intersegmental gaps, said rectilinear groove falling wholly within one of the intersegmental gaps and not meandering into material forming any of said segments.

2. Method according to claim 1, wherein said guiding step includes forming said groove in a direction such that the center line of said groove extends in a plane which passes through the axis of the cylindrical portion (5) of the intermediate stage commutator blank (4) and extends radially from said axis through the center line of the groove.

3. Method according to claim 1, wherein the step of placing the cylindrical tubular blank in a forming press comprises placing said blank in a ring press having a space corresponding to the thickness of the flange portion (6) and having a central punch or stamp element (14), and compressing the essentially cylindrical tubular blank (2) to flow the commutator metal into a space defining the flange, and bounded by an outer die which, further, defines the outer circumference of the cylindrical portion (5) of the intermediate stage commutator ring to form, in one step, the flange portion (6) and the intermediate portion of the intermediate stage commutator ring (4) by application of pressure to the stamp or punch element (14) of the forming press.

4. Method according to claim 1, wherein the step of guiding the flowing or forming of the metal comprises compressing the metal in a cylindrical press having inner and outer cylindrical elements (14, 17), at least one of said elements being formed with a rib or ridge extending in the direction of said crack or gap (3) to form said groove upon compression of the forming press.

5. Method according to claim 4, including the step of forming a groove on at least one of the surface of said flange portion (6) by compressing the metal in said forming press against a die element (10, 18) having a projecting ridge or rib defining said groove upon compression of the press.

6. Method according to claim 1, wherein said press comprises a ring punch (17, 18) movable against a counter element (10), and an outer die (8) within which die said ring punch element and said counter element are movable;

and a center cylindrical element (14) movable in a cylindrical space of said ring punch element (17, 18);

said step of placing the cylindrical tubular blank (2) in the forming press comprises fitting the cylindrical tubular blank (2) over said center cylindrical element (14);

and said step of forming or flowing the metal comprises applying axially directed pressure by a pressure stamp (20) against the cylindrical tubular blank on the center cylindrical element to permit the metal to escape in the space between the ring punch element and the counter element (10) and bounded by the outer die (8) to form said flange portion (6) and, simultaneously, to form said cylindrical portion (5) by flowing the metal around the center cylindrical element (14) and within the ring punch element (17, 18) upon compression by the punch element (20).

7. Method according to claim 6, wherein at least the center cylindrical element (14) is formed with a radially outwardly projecting ridge or rib (26);

the step of placing said cylindrical tubular element (2) in the forming press comprises aligning the gap or crack (3) with said rib or ridge;

and the step of guiding the forming or flowing of the metal comprises compressing the metal by said punch element (20) with the rib or ridge (26) sliding within the gap or crack, to form said groove.

8. Method according to claim 7, wherein the counter element (10) is formed with a radially extending rib or ridge (31) positioned in radial alignment with the rib or ridge (26) on the center cylindrical element (14);

and wherein the step of forming or flowing the metal comprises compressing the metal against the counter element to form a radially extending groove (29) in an end face (30) of the flange portion (6) of the intermediate stage commutator ring (4).

9. Method according to claim 6, wherein both the ring punch element (17, 18), the counter element (10) and the center cylindrical element (14) are formed with projecting ribs;

the step of placing the cylindrical tubular blank (2) in the forming press comprises aligning the gap or crack with at least one of said ribs;

and the step of forming or flowing the metal comprises compressing the metal by the punch and, simultaneously, forming the flange portion (6), the cylindrical portion (5), and grooves in alignment with said gap or crack at the inner face and the outer face of the cylindrical portion (5) and at least one of the faces of the flange portion (6).

10. Method according to claim 6, wherein the step of forming or flowing the metal comprises additionally forming a recess (39) in an end face of the flange portion (6) to form an anchoring recess by providing a ring-shaped projection on said counter element (10) about which the metal is formed or flowed.

11. Method according to claim 6, wherein the step of forming or flowing of the metal comprises forming an anchoring projection (42) projecting from the flange portion (6) of the intermediate stage commutator ring (4) by flowing the metal into a depression formed in the counter element (10).

12. Method according to claim 1, wherein the step of forming or flowing of the metal comprises cold-flowing the metal in a punch press.

13. In the production of a commutator segmental ring, apparatus to make an unsegmented intermediate stage commutator ring (4) from an essentially cylindrical tubular blank (2) having a gap or crack (3) extending essentially axially along the tubular blank, comprising a punch press having a ring punch element (17, 18) of essentially cylindrical shape, and having an internal bore (19) of a diameter corresponding to the diameter of the intermediate stage commutator ring;

an essentially cylindrical die (8) having an inner opening (9) corresponding to the outer diameter of a flange portion (6) to be formed on the commutator ring, the ring punch element being movable within the bore (9) of the die (8);

a counter element (10) movable within the bore (9) of the die;

a center cylindrical element (14) movable within the counter element (10) and the ring punch element and having an outer diameter corresponding to the inner diameter of a cylindrical portion (5) formed on the intermediate stage commutator ring (4);

compression punch means (20) movable in the space defined between the inner diameter (19) of the ring punch element (17, 18) and the outer diameter of the center cylindrical element (14); and a radially projecting rectilinear ridge or rib (26,31,35,38) formed on at least one of said elements and engageable with the gap or crack (3) of the essentially tubular cylindrical blank to permit cold-flowing and simultaneous sizing of the cylindrical tubular blank (2) into the unsegmented intermediate stage commutator ring (4), without circumferential meandering of said gap or crack, upon compression of the cylindrical tubular blank about the center cylindrical element and within said die and counter element (17, 18).

14. Apparatus according to claim 13, wherein the ridge or rib is formed on the center cylindrical element (14).

15. Apparatus according to claim 13, wherein the rib or ridge is formed on the ring punch element (17, 18).

16. Apparatus according to claim 13, wherein the rib or ridge extends radially and is formed on the counter element (10).

17. Apparatus according to claim 13, wherein the rib or ridge extends radially from the surface of the respective element in a plane passing through the axis of the center cylindrical element and through the center line of the rib or ridge.

18. Apparatus according to claim 17, wherein the ridge or rib is formed on the center cylindrical element (14).

19. Apparatus according to claim 17, wherein the rib or ridge is formed on the ring punch element (17,18).

20. Apparatus according to claim 17, wherein the rib or ridge extends radially and is formed on the counter element (10).

* * * * *